US011154909B2

(12) United States Patent
Brennan

(10) Patent No.: US 11,154,909 B2
(45) Date of Patent: Oct. 26, 2021

(54) ELECTRIC BRUSH FOR SAND REMOVAL

(71) Applicant: Patrick F. Brennan, Waterford, CT (US)

(72) Inventor: Patrick F. Brennan, Waterford, CT (US)

( * ) Notice: Subject to any disclaimer, the term of this patent is extended or adjusted under 35 U.S.C. 154(b) by 119 days.

(21) Appl. No.: 16/455,037

(22) Filed: Jun. 27, 2019

(65) Prior Publication Data

US 2020/0001329 A1 Jan. 2, 2020

Related U.S. Application Data

(60) Provisional application No. 62/691,557, filed on Jun. 28, 2018.

(51) Int. Cl.

| | |
|---|---|
| ***A46B 13/02*** | (2006.01) |
| ***B08B 1/00*** | (2006.01) |
| ***A46B 13/00*** | (2006.01) |
| ***B08B 1/04*** | (2006.01) |

(52) U.S. Cl.

CPC ..... *B08B 1/002* (2013.01); *A46B 13/001* (2013.01); *A46B 13/02* (2013.01); *B08B 1/04* (2013.01); *A46B 2200/1006* (2013.01)

(58) Field of Classification Search

CPC ..... A46B 13/001; A46B 13/02; A46B 2200/1006; A46B 2200/102

USPC ..... 15/22.1

See application file for complete search history.

(56) References Cited

U.S. PATENT DOCUMENTS

| | | | | |
|---|---|---|---|---|
| 4,196,492 | A | 4/1980 | Johnson et al. | |
| 4,210,978 | A | 7/1980 | Johnson et al. | |
| D262,029 | S | 11/1981 | Osrow et al. | |
| D302,612 | S | 8/1989 | Duran et al. | |
| 5,094,558 | A | 3/1992 | Chu | |
| 5,189,753 | A | 3/1993 | Sousa et al. | |
| 5,423,102 | A * | 6/1995 | Madison | A46B 13/04 15/22.1 |
| 5,450,646 | A * | 9/1995 | McHugh | A46B 13/02 15/179 |
| 5,511,269 | A * | 4/1996 | Watson | A46B 5/0033 15/22.1 |
| 5,870,790 | A * | 2/1999 | Root | A61C 17/16 15/22.1 |
| 5,950,268 | A * | 9/1999 | Murphy | A46B 13/02 15/28 |
| 6,374,447 | B1 * | 4/2002 | Armbruster | A46B 13/008 15/144.1 |
| D457,327 | S | 5/2002 | Liu | |
| 6,966,098 | B2 | 11/2005 | Sako et al. | |
| D514,331 | S | 2/2006 | Liu | |

(Continued)

OTHER PUBLICATIONS

Sand-Off—Convenient Sand Wipe-Off Mitt.

(Continued)

*Primary Examiner* — Randall E Chin

(74) *Attorney, Agent, or Firm* — Onofrio Law; Dara L. Onofrio

(57) ABSTRACT

A foldable, compact electric brush for removing dirt and sand from a body including a brush, a handle with at least one handle extension; a tubular component with two swivel joints on opposite sides for attaching the brush and handle extension; a motor to turn the brush; a rechargeable power source and a power button to power on and off.

18 Claims, 5 Drawing Sheets

(56) References Cited

U.S. PATENT DOCUMENTS

| | | | | |
|---|---|---|---|---|
| 8,347,443 | B1 * | 1/2013 | Conrad | A46B 11/002 15/24 |
| 9,340,184 | B1 * | 5/2016 | Morris | B60S 3/048 |
| 10,342,326 | B2 * | 7/2019 | Outa | A46B 13/02 |
| 2003/0097724 | A1 * | 5/2003 | Park | A47K 7/04 15/23 |
| 2003/0213078 | A1 * | 11/2003 | Kristofek | B08B 1/04 15/97.1 |
| 2004/0083567 | A1 * | 5/2004 | Lies | A47L 11/162 15/28 |
| 2004/0117931 | A1 * | 6/2004 | Washington | A46B 13/008 15/29 |
| 2005/0066458 | A1 * | 3/2005 | Belcastro | A46B 13/001 15/28 |
| 2010/0043168 | A1 | 2/2010 | Johnson et al. | |
| 2011/0114116 | A1 | 5/2011 | Williams | |
| 2013/0232704 | A1 | 9/2013 | Zheng et al. | |
| 2017/0055692 | A1 * | 3/2017 | Wobill | A46B 11/063 |
| 2017/0273524 | A1 | 9/2017 | Klintemyr et al. | |
| 2018/0228276 | A1 * | 8/2018 | Gregori | A46B 13/02 |

OTHER PUBLICATIONS

Business Insider Article: "Finally, someone made a convenient way to wipe off sand from your skin"—https://www.businessinsider.com/sand-removing-mitt-beach-toy-2017-6.

Surf Brush All Purpose Beach Sand Brush—https://www.amazon.com/Surf-Brush-Purpose-Beach-Sand/dp/B009POHLS6/ref=sr_1_2?crid=LIB80JLLX8MR&keywords=surf+brush+all+purpose+beach+sand +brush&qid=1565285114&s=gateway&sprefix=surf+brush+all+pur%2Caps%2C147&sr=8-2.

Powder Pouch Sand Remover—https://www.bedbathandbeyond.com/store/product/powder-pouch-reg-sand-remover/1015993537.

Etiger® Computer Vacuum Mini USB Keyboard Cleaner Desktop Laptop Brush Dust Cleaning Kit—https://www.amazon.com/Etiger%C2%AE-Computer-Keyboard-Cleaner-Cleaning/dp/B00OROL0KO/ref=sr_1_5?keywords=Etiger%C2%AE+Computer+vacuum+mini+usb+desktop+laptop&qid=1565285315&s=gateway&sr=8-5.

Rhino USB Powered Mini Vacuum FD-368—https://express.google.com/product/7151597153072958 01_10215759155653730596_6136318?mall=WashingtonDC&directCheckout=1&utm_source=google_shopping&utm_medium=product_ads&utm_campaign=gsx&dclid=ClfC8uzUwdoCFYy3yAoduF8BuA.

* cited by examiner

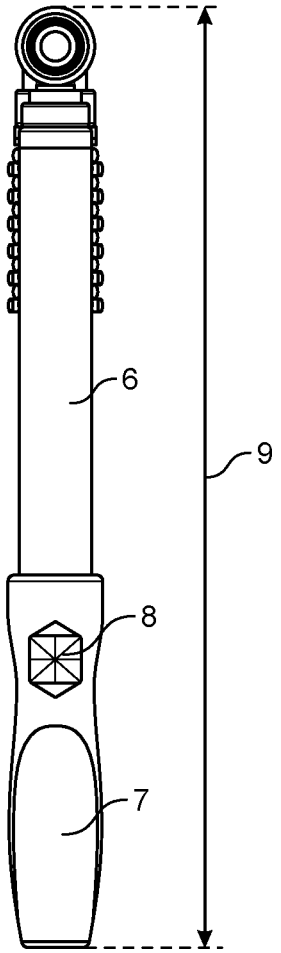
FIG. 2A
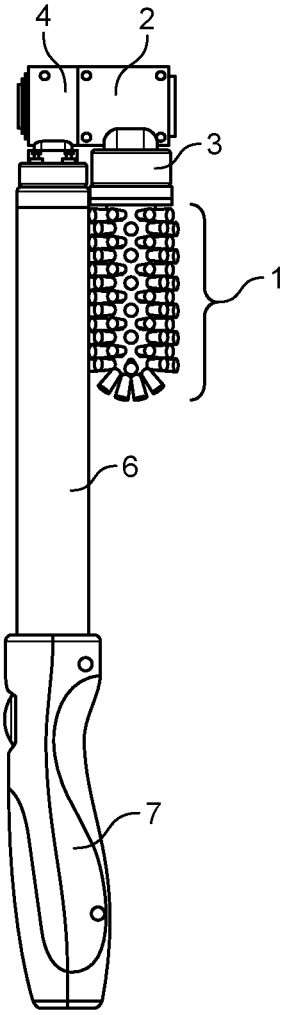
FIG. 2B
FIG. 2

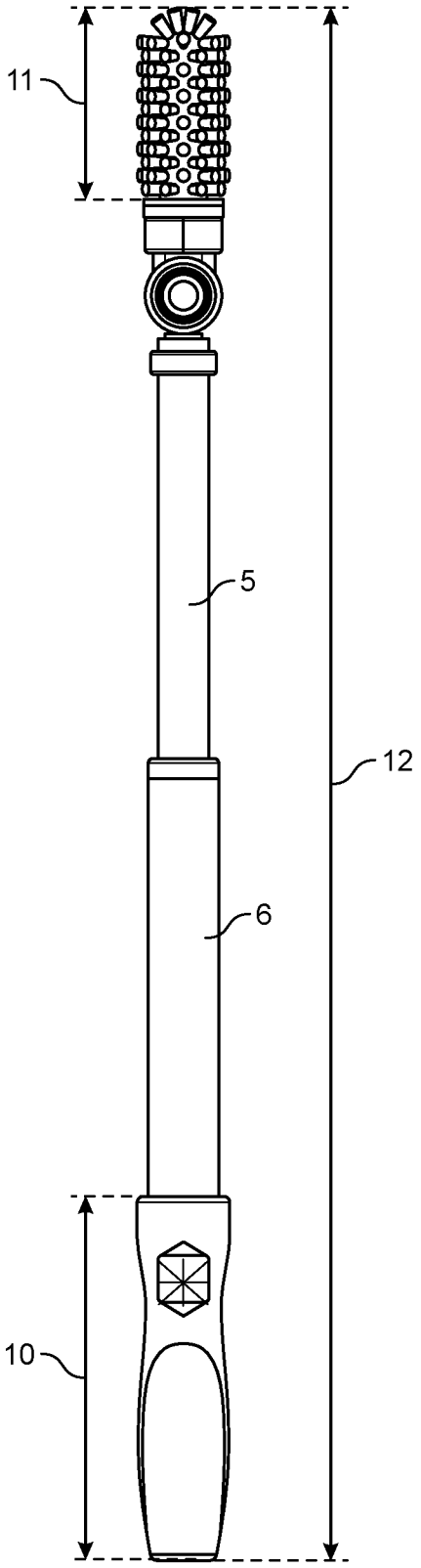
FIG. 3A
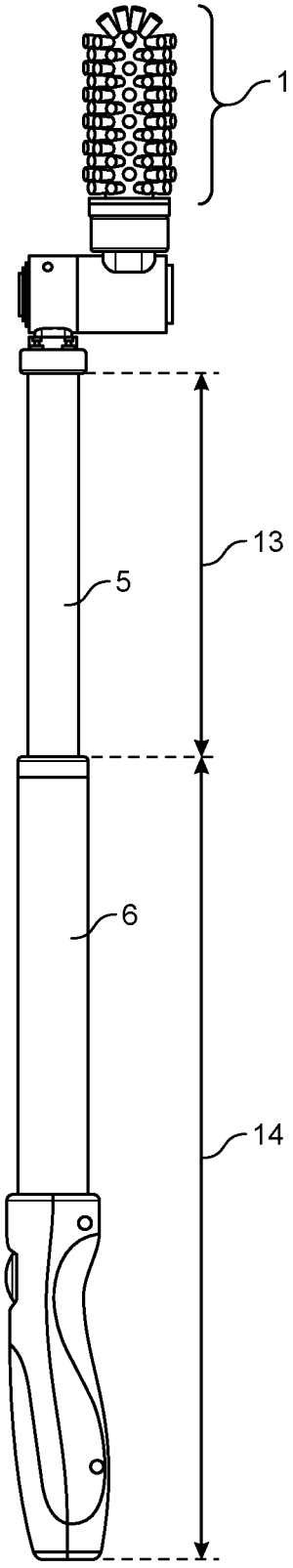
FIG. 3B
FIG. 3

ELECTRIC BRUSH FOR SAND REMOVAL

This application claims the benefit of U.S. provisional application Ser. No. 62/691,557 filed Jun. 28, 2018 which is incorporated herein in its entirety by reference.

FIELD OF THE INVENTION

The present invention relates to an electric brush for dirt and sand removal from a body. More particular, the invention relates to a foldable, compact hand held electric car brush including a brush attached to at least one extension handle, with swivel joints for twisting to open and close positions.

BACKGROUND OF THE INVENTION

In general, brushes and vacuums for removing sand are known in the prior art. Illustrative of these devices include the following.

U.S. Pat. No. 5,094,558 to Chu which is directed to a handheld brush.

U.S. Pat. No. 5,189,753 to Sousa et al. which is directed to a vacuum cleaner in the trunk of the car connected to the battery as a power source.

U.S. Patent Publication 20110114116 to Williams which discloses a brush attachment with an extension handle. Williams describes the brush attachment as a steam cleaner.

Products currently sold commercially for cleaning sand off a person's skin include: a Sand-Off mitt which is described as a coarse-like mesh mitt to brush sand off; a Surf Brush described as an all-purpose beach sand brush; and a Powder Pouch sand remover which is basically a powdered bag to wipe the sand away from your skin.

Commercially sold USB vacuum cleaners are known which are used for cleaning desktop laptops and keyboards. These types of cleaners only have limited power to remove dust from the computer laptops and keyboard.

Unlike the prior art devices, the invention provides a handheld compact electronic car brush which plugs into a vehicle's battery or USB port, or any USB port source, for recharging and is used to remove sand and debris from the user's skin.

A general objective of the invention is to provide a device to enable the user to remove all the sand from the user's skin before entering the vehicle.

Another object of the invention is to provide a handheld device to remove sand and debris without having to wipe or wash it off.

Yet another object of the invention is to provide a rechargeable device that can be easily stored in an automobile.

Another object of the invention is to provide a rechargeable device that can be recharged using the vehicle USB port or charger.

Still another object of the invention is to provide an electric brush without the need for bags or collection.

Yet still another object of the invention is to assist a user that may have a physical need or limitation, to assist in removing sand with ease.

SUMMARY OF THE INVENTION

In the present invention, these purposes, as well as others which will be apparent an electric brush for removing dirt and sand from a body is provided made of a brush (1), a handle (7), at least one handle extension (5), a tubular component (2) with a first swivel joint (3) to attach said brush (1) and a second swivel joint (4) to attach the handle extension (5), a motor (16) to turn said brush (1), a rechargeable power source (18) which provides power to said motor (16) and a power button (8) to turn the power source (18) on and off.

The components of the invention are made of plastic, metal, rubber or synthetic materials, preferably light weight plastic material.

Other objects, features, and advantages of the present invention will be apparent when the detailed description of the preferred embodiments of the invention are considered with reference to the drawings, which should be construed in an illustrative and not a limiting sense.

BRIEF DESCRIPTION OF THE DRAWINGS

FIG. 2 includes FIG. 2A which is a frontal view of the invention and respective dimension in a fully compacted position and FIG. 2B illustrates a side view of this perspective;

FIG. 3 includes FIG. 3A which is a frontal view of the invention and respective dimension in a fully extended position and FIG. 3B illustrates a side view of this perspective;

DETAILED DESCRIPTION OF THE INVENTION

Figures 1, 1A, 1B:
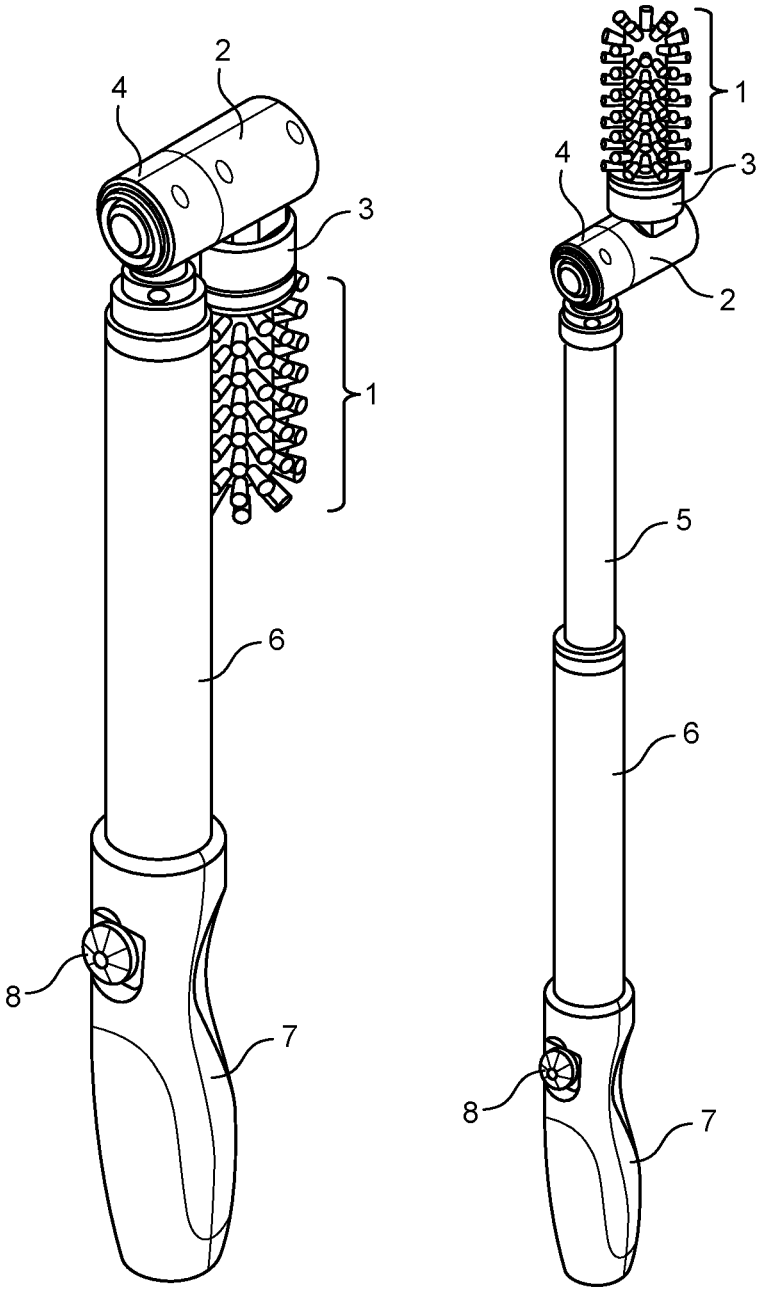
FIG. 1 includes FIG. 1A which illustrates the components of the invention in a fully compacted position and FIG. 1B illustrates the components of the invention in a fully extended position.

As shown in the drawings, the reference numerals refer to the following structures:

1—brush;
2—tubular component with swivel joints to attach to brush and handle structures;
3—first swivel joint of tubular component to attach to brush;
4—second swivel joint of tubular component to attach to handle extension;
5—handle extension;
6—additional handle extension;
7—handle;
8—power button;
9—compacted length of the device;
10—height of the handle;
11—height of the brush;
12—extended length of the device;
13—length of the handle extension;
14—length of the additional handle extension;
15—brush attachment to attach brush to first swivel joint;
16—motor (inside component) to power brush;
17—handle attachment to attach handle extension to second swivel joint;
18—rechargeable power source;
19—charging module;
20—handle grip;
21—USB port;
22—indicator light for power;
23—battery charge indicator;
24—brush release button; and
25—sand guard shield.

In accordance with the present invention, and as shown in FIG. 1 which includes FIG. 1A and FIG. 1B, a foldable, compact handheld electronic brush for removing dirt and sand from a body is provided. FIG. 1A illustrates the invention in a compact position for storage and FIG. 1B illustrates the invention device in an extended position ready for use.

The structural components of the invention device include a brush 1; a handle 7; at least one handle extension 5; a tubular component 2 with a first swivel joint 3 to attach the brush 1 and a second swivel joint 4 to attach the handle extension 5; a motor 16 to turn said brush 1; a rechargeable power source 18 which provides power to said motor 16; and a power button 8 to turn said power source 18 on and off.

The brush used in the invention is made of material that will readily remove dirt and sand without chafing or scraping the user's skin. Preferably the brush is made of nylon and is 1 inch wide by 3 inches long. The brush can be cleaned easily with soap and water without removing from the device.

In alternate embodiments the brush can be removed and replaced with different size brushes having different bristles. In another embodiment the brush is sufficient to remove dirt and sand from a pet such as a dog or cat.

In all embodiments of the invention, the brush easily removes dirt and sand without the need for using water.

The motor 16 is used to rotate the brush. The speed of rotation is preferably between 200 rpm to 300 rpm which is strong enough to remove dirt and sand but gentle enough not to hurt the user's skin.

The invention also includes an additional handle extension (6). It is contemplated within the invention that there can be up to three extension handles. The lengths of these handles can vary. In all embodiments each extension handle is telescoping and is held in the desired place by twisting and/or with a lock nut.

Optionally, the invention includes at least one LED light on the device. Multiple LED lights can be included along the extension handle, handle or plastic shield. These lights can help to illuminate the area when it is dusk or dark.

FIG. 2 includes FIG. 2A which is a frontal view of the invention and respective dimension in a fully compacted position and FIG. 2B illustrates a side view of this perspective. The lengths provided herein are for illustrative and not limiting purposes of the invention. As illustrated in these figures the length of the compacted device 9 is between 8 to 16 inches, preferably 10 to 15 inches.

FIG. 3 includes FIG. 3A and FIG. 3B. FIG. 3A is a frontal view of the invention and respective dimension in a fully extended position and illustrates the length of the brush 11 is between 1 to 6 inches, preferably 3 inches. The length of the handle 10 is between 4 to 8 inches, preferably 6 inches.

FIG. 3A also illustrates the length of the extended device 12 is between 16 to 26 inches, preferably 18 to 21 inches.

FIG. 3B illustrates a side view of this perspective, showing the length of the handle extension 13 is between 5 to 8 inches, preferably 6 inches; and the length of the additional handle extension 14 is between 5 to 8 inches, preferably 7 inches.

The unit itself is telescopic, wherein the user can extend the handle extension 13 and additional handle extension 14 to the desired length according to their need.

Lock nuts can be used to hold the handle extensions at the desired length. All the user has to do is twist the handle extension at the desired length to engage the lock nuts. When the user is finished using the device, they twist the handle extension to unlock and fold the extensions in a telescoping manner. A tensioner can also be used and is a device that applies a force to create or maintain tension.

In an alternate embodiment a third extension handle can be incorporated into the invention device so that the telescoping length can be increased even beyond lengths stated above. The third extension would be pre-built into the device itself and not added on by the user.

Figure 4:
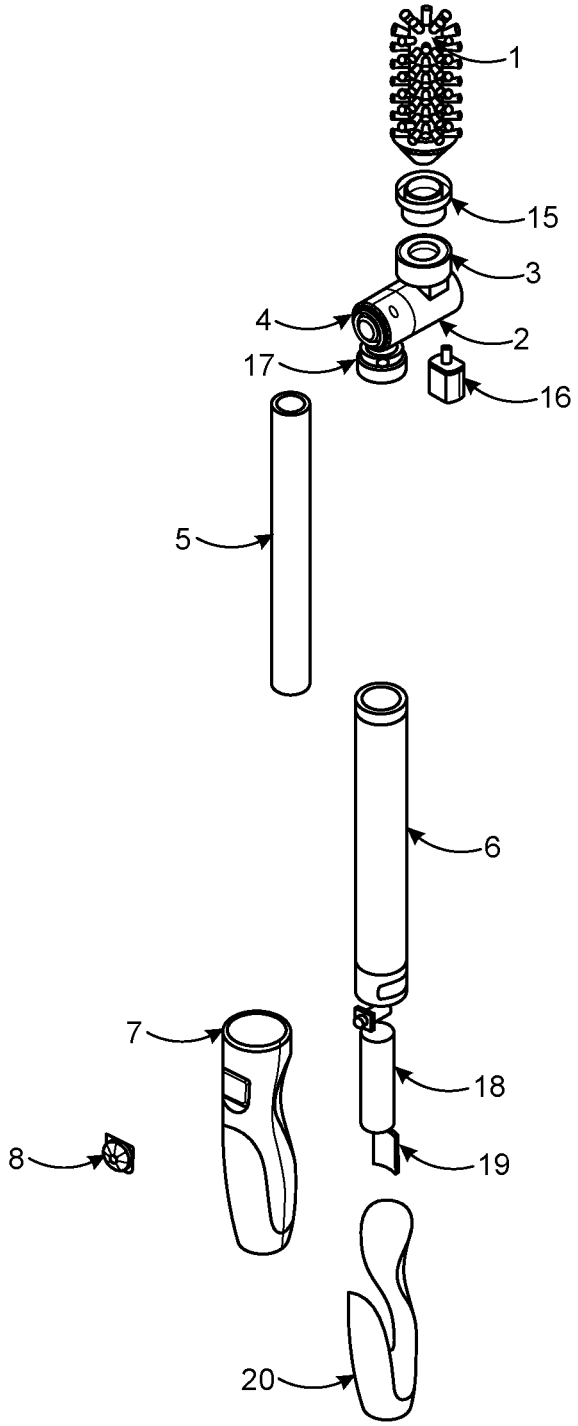
FIG. 4 is a detailed illustration of the components according to the invention.

FIG. 4 is a detailed illustration of the components according to the invention and illustrates more detailed components of the device. A brush attachment 15 is shown which is used to attach the brush 1 to first swivel joint 3 on the tubular component 2. A handle attachment 17 is shown to attach the handle extension 5 to the second swivel joint 4 on the tubular component 2.

A charging module 19 is shown attached to the rechargeable power supply. The charging module is used to connect the USB port to charge the battery.

A handle grip 20 is shown. This is optional and can be used to provide the user with a better grip. The grip can be made of rubber and slips on and off of the handle 7.

The device includes a rechargeable power source 18 which preferably plugs into the vehicle's battery or USB port, or any USB port source. The power source can be any battery that is capable of being recharged. The battery is an internal battery that is preferably recharged and not replaced, but the battery could be replaced. Lithium rechargeable batteries are preferred since they hold their charge longer than most other batteries.

Figure 5:
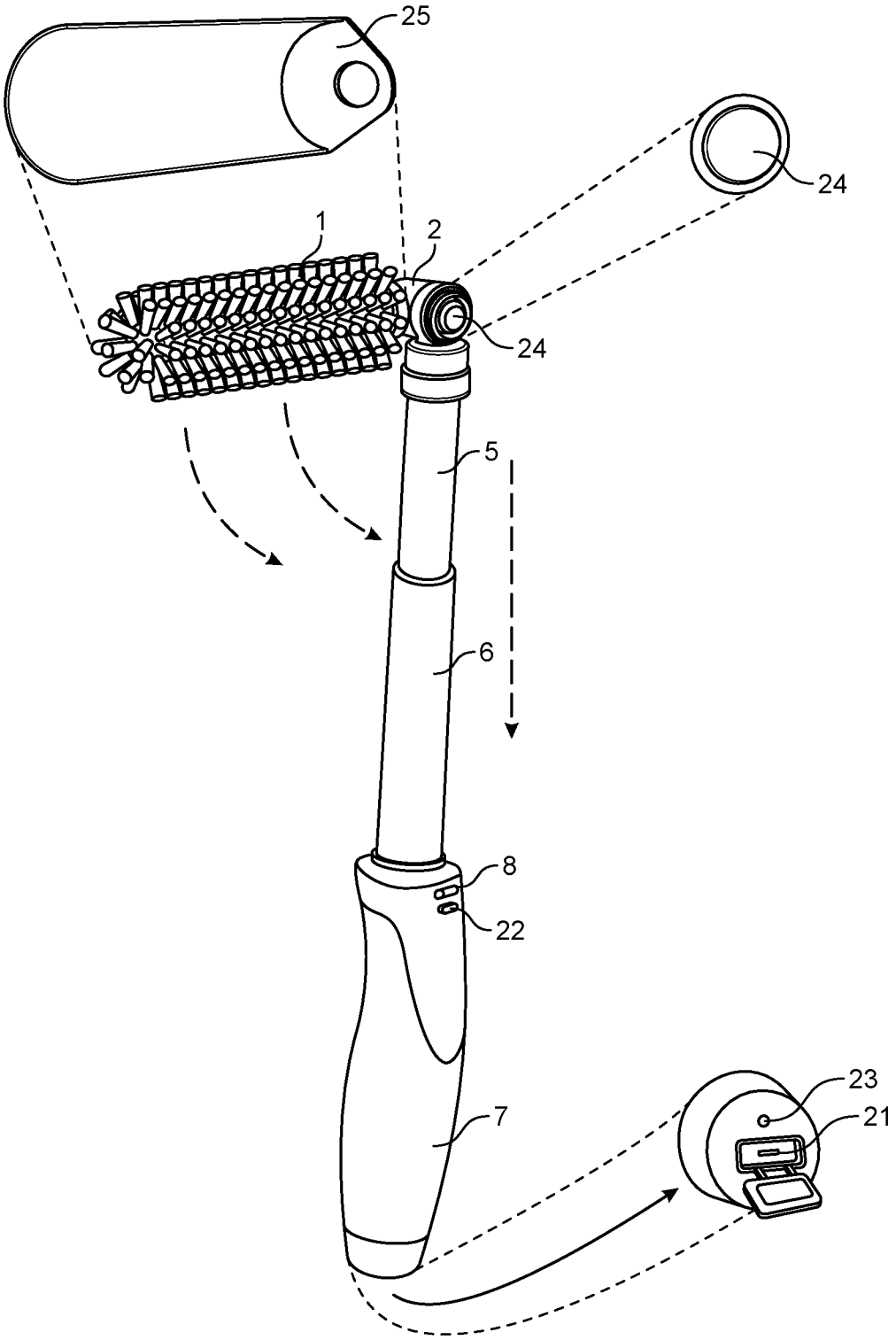
FIG. 5 is an illustration of additional components according to the invention.

As shown in FIG. 5, the invention also includes a USB port 21 for recharging said power source 18. The USB port is preferably on the handle portion of the device and most preferably at the bottom, as illustrated. There is also a battery charge indicator light 23 next to the USB port 21 and indicates whether the battery needs a charge by showing either a red light—charging needed; or a green light—indicating full charge.

The invention also shows in FIG. 5 an indicator light 22 which enables the user to visually see when the device is activated. When activated a green light is on and when the device is off and not being used there is no light on. This indicator light is preferably above or below the power button 8 which turns the device on and off.

A button 24 is included and is a brush detach button. The button is pressed to remove the brush from the tubular component 2. It also permits the user to either fold the brush down towards the extension handle for storage or fold the brush in an upright position ready for use.

A sand guard shield 25 is also shown as part of the invention. This sand guard shield is placed over the brush so that when the brush is in use the dirt and/or sand doesn't spray back on user but is deflected away from the user's skin. The guard is preferably made of plastic and easily pops on and off the device. It does not interfere with the brush rotation.

The entire device is fully sealed and water resistant.

The invention brush is preferably bendable.

A waterproof case optionally may be provided over the device.

In all embodiments the device is made of a hard, durable plastic material. The retractable handle may be made of the same material or of a metal that will not rust or corrode.

The device is made of three moving parts, the head unit that the motor is sealed in; the body where the motor is attached to; and the retractable handle where the rechargeable battery is sealed into.

When a user is ready to use the invention device it is removed from the storage bag. The brush 1 is extended into an upright position and locked in place. Using the power button 8 the device is turned on and the indicator light for power 22 is checked to be green. The brush begins to spin at an average of 200 to 300 rpm. The user places the brush on the skin or other surface where sand and dirt is to be removed by pushing it downward and away from the body surface.

The brush rotates in a circular motion. The force of the motion is such that it pushes the dirt and debris in a downward direction and prevents it from flying back and the user going all over preventing a messy situation. The sand guard shield 25 helps keep the sand from flying back at the user. The invention brush enables the user to remove sand or debris from the user without having to wash or wipe it off.

There are various speed controls. Once the device is turned on the motor will turn in reverse direction to brush the sand downwards toward the ground. If the device is turned around the brush will push the sand upwards. There is no sensor when the brush hits the surface. Once the brush is on it is moving and spinning until the unit is turned off. The device head with the brush will swivel down parallel to the handle and the device itself will retract into 8 to 16 inches length for easy storage.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. An electric brush for removing dirt and sand from a body comprising:

a brush (1);

a handle (7);

at least one handle extension (5);

an additional handle extension (6) wherein said handle extension (5) can extend out from said handle extension (6) to form an extended device or collapse into said handle extension (6) to form a compacted device;

a tubular component (2) with a first swivel joint (3) to attach said brush (1) and a second swivel joint (4) to attach said handle extension (5);

a motor (16) to spin said brush (1);

a rechargeable power source (18) which provides power to said motor (16); and a power button (8) to turn said power source (18) on and off;

wherein said handle extension (5) extends out from said handle extension (6) and said brush (1) extends in a vertical direction from said handle extension (5) to form the extended device.

2. The electric brush according to claim 1, further comprising a USB port (21) for recharging said power source (18).

3. The electric brush according to claim 1, wherein said handle extension (5) is collapsed into said handle extension (6) and said brush (1) is folded parallel to said handle extension (6) to form the compacted device.

4. The electric brush according to claim 3, wherein the length of the compacted device (9) is between 8 to 16 inches.

5. The electric brush according to claim 3, wherein the length of said additional handle extension (6) and said handle (7) is between 5 to 8 inches (14).

6. The electric brush according to claim 1, further comprising an indicator light (22).

7. The electric brush according to claim 1, wherein the length of the handle (13) is between 4 to 8 inches.

8. The electric brush according to claim 1, wherein the length of the brush (11) is between 1 to 6 inches.

9. The electric brush according to claim 1, wherein the length of said extended device (12) is between 16 to 26 inches.

10. The electric brush according to claim 1, wherein the length of said handle extension (13) is between 5 to 8 inches.

11. The electric brush according to claim 1, further comprising a brush attachment (15) to attach said brush (1) to first swivel joint (3) on tubular component (2).

12. The electric brush according to claim 1, further comprising a sand guard shield (25).

13. The electric brush according to claim 1, further comprising a handle attachment (17) to attach said handle extension (5) to said second swivel joint (4) on said tubular component (2).

14. The electric brush according to claim 1, further comprising a charging module (19).

15. The electric brush according to claim 1, further comprising a handle grip (20).

16. The electric brush according to claim 1, further comprising a brush release button (24).

17. The electric brush according to claim 1, further comprising a battery charge indicator (23).

18. An electric brush for removing dirt and sand from a body comprising: three movable parts consisting of a first part comprising a head unit containing a motor (16) and a rotatable brush (1);

a second part comprising a body portion attached to the head unit; and a third part comprising a retractable handle (7) where a rechargeable battery is sealed into to power the motor (16);

such that said first, second and third parts are movable to extend out from each other to form an extended device or to collapse into each other to form a compacted device such that when the device is in an extended position it is ready for use or when the device is in a compacted position it is ready for storage wherein said head portion extends in a vertical direction from said body portion to form the extended device and said head portion is folded parallel to said body portion to form the compacted device.

* * * * *